United States Patent [19]

Pottier et al.

[11] 4,393,946

[45] Jul. 19, 1983

[54] WELL PERFORATING APPARATUS

[75] Inventors: Alain Pottier, Houston, Tex.; Pierre Chesnel, Savigny-sur-Orge; Bernard Chaintreau, Avon, both of France

[73] Assignee: Schlumberger Technology Corporation, Houston, Tex.

[21] Appl. No.: 291,868

[22] Filed: Aug. 10, 1981

[30] Foreign Application Priority Data

Aug. 12, 1980 [FR] France ..... 80 17723
Feb. 10, 1981 [FR] France ..... 81 02547

[51] Int. Cl.[3] ..... E21B 43/117

[52] U.S. Cl. ..... 175/4.56; 102/306; 102/321

[58] Field of Search ..... 175/4.51–4.56; 166/55.1, 55, 297; 102/306, 321, 319, 320, 331

[56] References Cited

U.S. PATENT DOCUMENTS

| | | | |
|---|---|---|---|
| 2,644,519 | 7/1953 | Kanady | 175/4.53 |
| 2,799,229 | 7/1957 | Long | 175/4.53 |
| 3,048,101 | 8/1962 | Lebourg | 102/20 |
| 3,078,797 | 2/1963 | Blair | 102/20 |
| 3,100,443 | 8/1963 | Pohoriles | 175/4.51 |
| 3,104,611 | 9/1963 | Baks | 102/20 |
| 3,121,389 | 2/1964 | Delacour | 102/20 |
| 3,177,808 | 4/1965 | Owen | 102/20 |
| 3,276,369 | 10/1966 | Bell | 102/24 |
| 3,305,032 | 2/1967 | Schuster | 175/4.52 |
| 3,415,321 | 12/1968 | Verghiattis | 166/297 |
| 3,565,188 | 2/1971 | Hakala | 175/4.6 |
| 3,965,993 | 6/1976 | Lavigne et al. | 175/4.6 |

*Primary Examiner*—William F. Pate, III

[57] ABSTRACT

The apparatus comprises an elongated support (22) having a series of flat-faced sections and explosive charges (23) mounted perpendicular to the flat faces. Detonating cords are connected to the charges to fire them.

Each section of the support has two closely spaced attachment holes adapted to receive respectively the rear parts of the two charges mounted in opposite directions on each face of this section. The support is made up of a tube flattened transversely so as to form the flat-faced sections. Spacers are disposed between the charges and the support for casings of large diameter. The cases of the charges comprise a cover made of ceramic material and an extruded steel body which tends to flare out when the explosive is detonated rather than being broken into pieces.

21 Claims, 11 Drawing Figures

FIG. 1
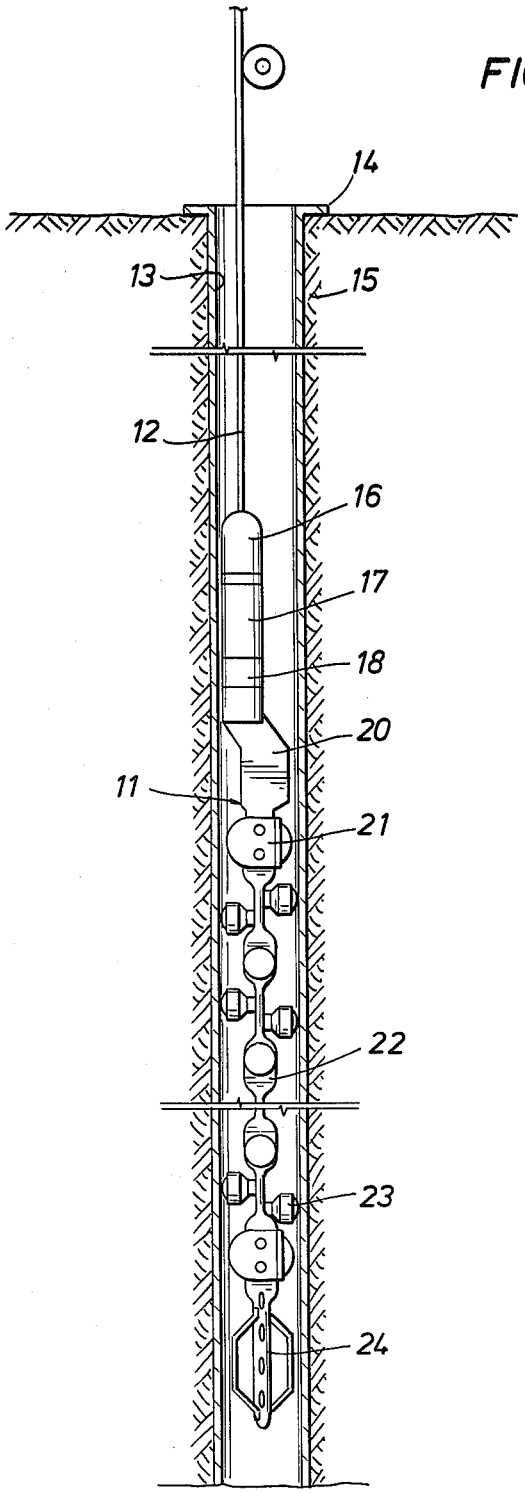
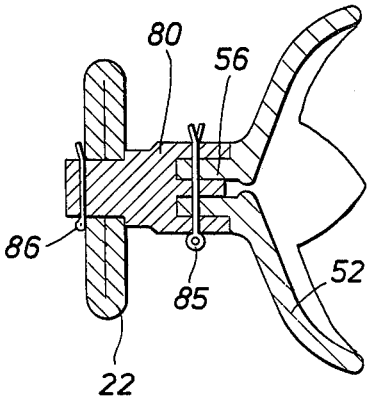
FIG. 10

FIG. 3
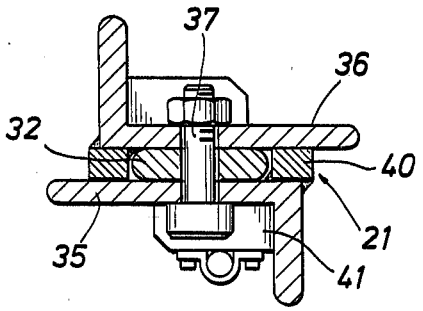
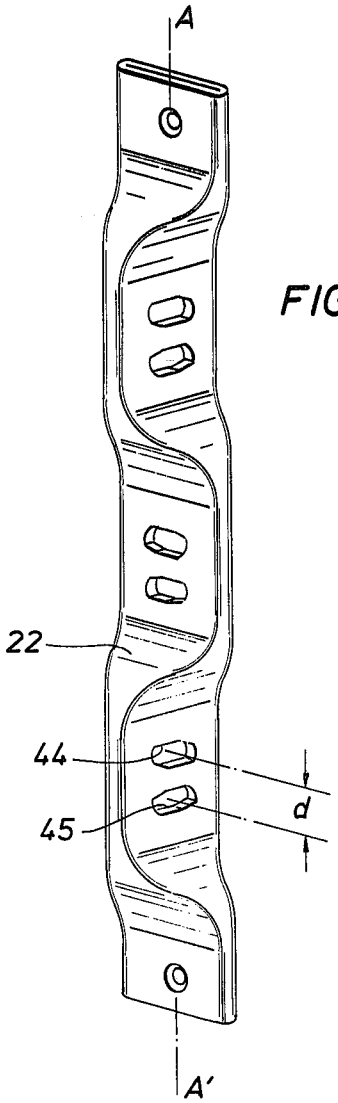
FIG. 5
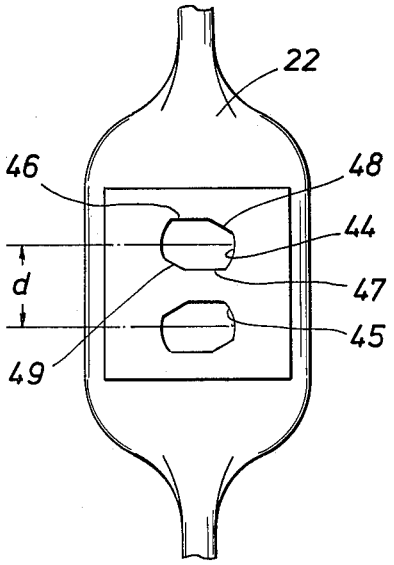
FIG. 4

WELL PERFORATING APPARATUS

REFERENCE TO RELATED APPLICATION

Reference is made to copending U.S. application Ser. No. 291,869, filed Aug. 10, 1981.

BACKGROUND OF THE INVENTION

This invention relates to apparatus for perforating wells, and more particularly to a shaped charge apparatus of the semi-expendable type.

Semi-expendable perforating devices typically comprise an elongated support along which are fixed radially directed encapsulated shaped charges. The assembly is lowered into a borehole to the depth at which it is desired to perforate the borehole casing and, after firing, the support is brought back up to the surface, with any pieces of the charge cases which have remained attached to the support. The parts of the charge cases broken free by the explosion constitute debris which remains in the well bore, but this amount of debris is limited thanks to the recovery of the support.

The supports used are often in the form of an elongated strip having attachment holes designed to receive the charges. Such devices are described for example in U.S. Pat. No. 2,756,677 (J. J. McCullough). For certain applications (for example, the preparation of a cased producing zone for the formation of a gravel pack), it is desirable to provide perforations of large diameter and in large number. These high charge density devices involve many constraints which have hitherto not been solved by the prior art.

Supports have been devised with a spirally twisted strip to obtain charges directed along several radial directions. The support described in the above-mentioned patent does not make it possible to fit a high charge density because of its very design and as a result of its lack of ruggedness. Such a support is twisted over its length after the attachment of the charges. As the charge attachment holes are also deformed by the twisting, it is possible that the charges will not be held with sufficient strength. In addition, if the known devices are used for well casings of different diameters, the same performance quality is not obtained everywhere. In well casings of large diameter, only the charges which bear against the casing exhibit good performance. The other charges, whose front faces are relatively far from the casing wall, lose a considerable part of their effectiveness. In perforating devices intended for the preparation of gravel packs, it is particularly important to obtain perforations of large diameter (2 cm, for example) spaced as regularly as possible in all directions. With prior art devices which, for example, can provide a shot density of as much as four holes per foot, it would be possible to obtain twice that density by lowering two of these devices to the same depth, but there is no known method for inserting them to obtain perforations with a regular distribution.

Another drawback of known semi-expendable perforating apparatus is the large amount of debris left in the well after the shaped charges are exploded. In fact, the explosion breaks almost all the charge cases into fragments, leaving on the support only the part of these cases actually fixed in the support. This drawback is particularly important for apparatus having a high density of charges.

It is thus desirable to have perforating devices capable of receiving a high charge density and offering excellent ruggedness but with a low manufacturing cost. This low cost is important because, even though the supports can genrally be reused, they do become damaged or deformed from time to time, and then must be replaced.

SUMMARY OF THE INVENTION

It is therefore an object of the present invention to provide a wellbore perforating apparatus particularly suitable for obtaining a high density of perforations of large diameter with a regular distribution.

Another object of the invention is to provide a perforating apparatus having a charge support which is particularly simple and robust.

Still another object of the invention is to reduce the amount of debris obtained with such an apparatus.

According to the invention, the well perforating apparatus comprises an elongated support made up of a series of flat-faced sections offset angularly around the longitudinal direction and having longitudinally spaced attachment holes, and explosive charges having sealed cases fixed in the attachment holes with their axes substantially perpendicular to the flat sides. Electrically operated detonating means are connected to the charges to fire them. Each support section has two attachment holes spaced longitudinally with a distance between centers smaller than the diameter of a charge perpendicular to its axis, and the charge cases have rear parts of reduced diameter adapted to engage in the attachment holes for fitting two charges along opposite radial directions on each of said sections. Preferably the support is made up of a tube whose successive parts are flattened edge to edge in predetermined radial directions to form the flat-sided sections.

The detonating means comprises an electrically operated detonator for causing the explosion of two detonating cords, one of which is connected to a first series of charges comprising a charge of each section and the other to a second series comprising the other charge of each section. The two cords are fired simultaneously by an explosive relay, which, if necessary, may be synchronized by other explosive relays. The case of each charge comprises a metallic body offering sufficient resistance for the attachment and a cover made up of a brittle material, such as ceramic. The rear part of the body of the charges has a slot for the passage of the detonating fuse.

The body of each charge case is made of extruded steel exhibiting a sufficient resistance in the direction of the charge axis and less resistance perpendicular to this axis so that the major part of each charge body opens under the effect of the explosion while remaining attached to the support by their rear parts after the explosion.

For large-diameter wells, spacers are placed between the support and the base of the charge cases. Each spacer comprises a reinforced annular part adapted to receive this rear part. Inside each annular part, the spacer comprises a transverse part adapted to be inserted in the detonating fuse passage slot when the rear part of a charge case is placed in the spacer, in order to reduce the volume of well fluid inside the annular part while ensuring suitable transmission of the explosion of the fuse toward the charge thanks to the proper application of this fuse against the charge case.

BRIEF DESCRIPTION OF THE DRAWINGS

The characteristics and advantages of the invention will better appear from the description to follow, given by way of non-limitative example and with reference to the appended drawings in which:

FIG. 1 is a general view of a perforating apparatus according to the invention, shown in a borehole;

FIG. 3 is a cross-sectional view taken along line 3—3 of FIG. 2A;

FIG. 4 is a detail of the support of the perforating apparatus;

FIG. 5 is a perspective view of the charge support of the apparatus;

FIG. 10 is a transverse section of an embodiment of the perforating apparatus after detonation of the charges.

DESCRIPTION OF THE PREFERRED EMBODIMENT

Figure 2A:
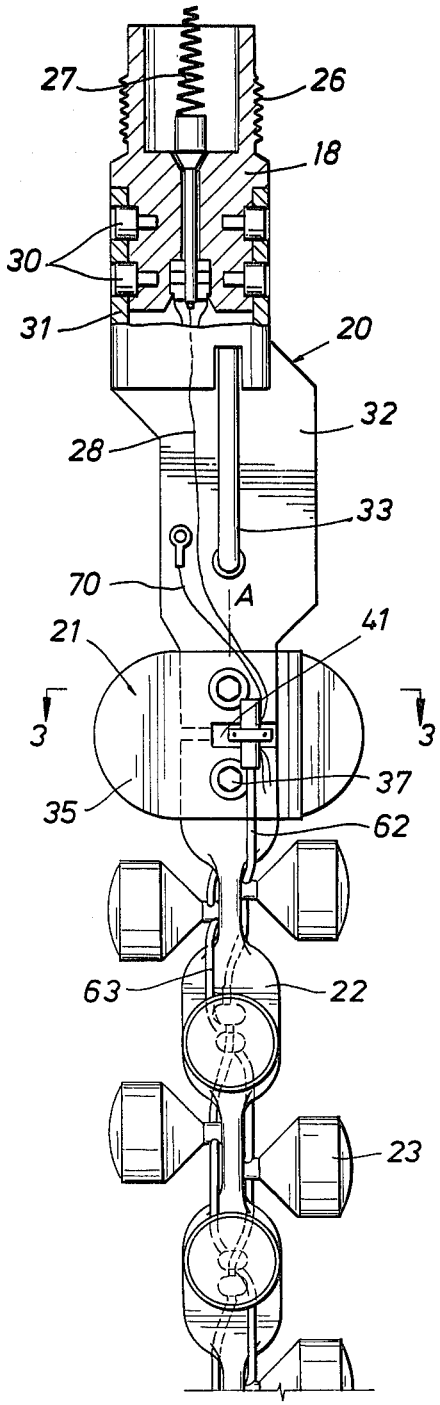
FIGS. 2A and 2B are partial sectional views of the apparatus of FIG. 1.

Referring to FIG. 1, a perforating apparatus 11 suspended from the end of a cable 12 is shown in a borehole 13 covered with a borehole casing 14 going through earth formations 15. To start the production of a certain zone containing hydrocarbons, it is necessary to prepare this zone for the setup of a gravel pack and, to accomplish this, perforate a large density of large diameter holes in this zone. The perforating apparatus 11 designed for this purpose is attached to a conventional cable head 16 via a casing collar locator 17 for determining the depth with accuracy. The perforating apparatus comprises an upper head 18, an adapter 20, one (or more) connecting element(s) 21, one (or more) support(s) 22 for charges 23, and a lower end piece 24.

Figure 2B:
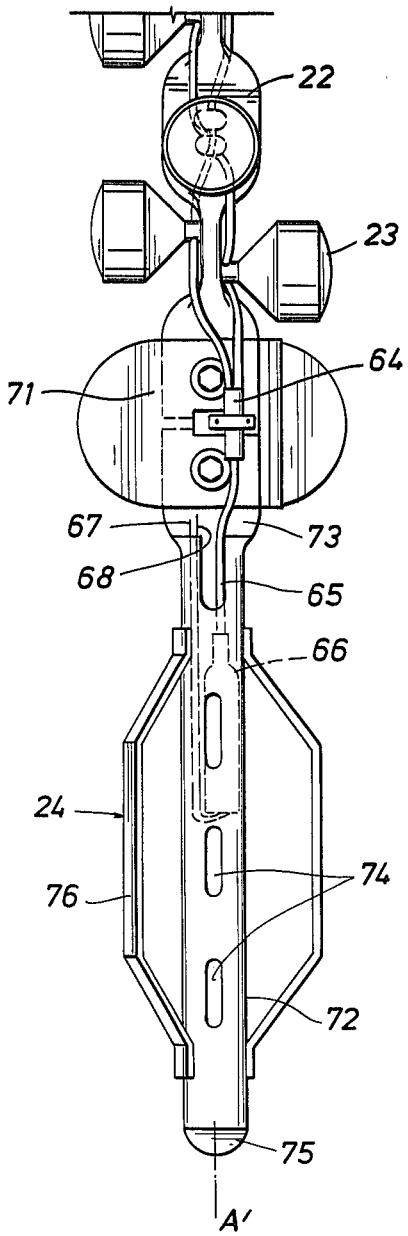

Referring to FIGS. 2A and 2B, the upper head 18 is cylindrical and has a thread 26 for attachment to the lower end of the casing collar locator 17. An electrical connector 27 mounted in an insulated and sealed manner within the axis of the head is connected at the bottom to an insulated conductor 28. The head 18 is attached, for example by screws 30, to the adapter 20 consisting of a sleeve 31 welded in an off-centered manner to a plate 32. Lateral braces 33 are welded between the sleeve 31 and the plate 32. It is preferable that the head 18 be off-centered in the borehole so that the casing collar locator 17 is near the wall of the well casing 14 and thus delivers a better signal. The plate 32 is connected to the support 22 via the connecting element 21. The connecting element 21, better shown in FIG. 3, is made up of two half-shells 35 and 36 attached to each other by means of screws 37. Each half-shell (for example 35) is made up of an angle-iron segment with rounded edges on which is welded a rail 40 of square section so that, after installation, the two half-shells allow a limited angular movement between the head 18 and the support 22. Each half-shell moreover has a transverse projection 41 on which can be fixed a detonating cord or an explosive relay and the electrical conductors.

The support 22, also shown in FIGS. 4 and 5, includes a series of flat-faced sections offset angularly by 90 degrees around the longitudinal direction AA'. Each section (see FIG. 4) is pierced with two attachment holes 44–45 spaced longitudinally to receive the rear portions of the charges. Each attachment hole, such as 44, has two transverse flats 46, 47 and two oblique flats 48, 49 to prevent the corresponding charge from turning around its axis. The distance d between the centers of the two attachment hole 44 and 45 of a section is clearly smaller than the maximum diameter of a charge taken perpendicular to its axis, in order to allow a high charge density. The charges are then mounted in opposite directions on each side of each section. Preferably, the holes 44 and 45 are as closely spaced as possible, while leaving between them a minimum strip of metal sufficient for allowing good charge attachment. In one embodiment, the distance d was about 2 cm for charges of about 5 cm diameter, the metal strip left between the two holes having a width of 8 mm.

The support 22 (FIG. 5) is fabricated from steel tubing of suitable diameter (4 cm in the example above) flattened along two radial directions in order to form the successive flat-faced sections. To accomplish this, the tube is placed in a press to flatten a section with a force of about 100 metric tons and then the tube is advanced by a section length, turning it 90 degrees around its axis before flattening the next section. The attachment holes are then punched out.

Before engaging the charges into the attachment holes, a first detonating cord 62 is placed (FIG. 2A) in the slots 60 (FIG. 6) of a first series of charges formed by the upper charge of each section, and a second detonating cord 63 is placed in the slots 60 of a second series of charges comprising the other charge (lower charge) of each section. Each detonating cord 62–63 is arranged helically around the carrier and extends down to an explosive relay 64. The explosive relay 64, connected by means of another detonating cord 65 to a detonator 66, is designed to fire simultaneously the two cords 62 and 63. The detonator 66 has two electrical firing wires 67 and 68 connected upward along the carrier 22 respectively to the insulated conductor 28 and to a second conductor 70 connected to ground. The detonator 66, the detonating cords, and all the charges 23 are fired by sending a suitable electric current between the connector 27 and the ground via the cable 12.

In a conventional manner, it is preferable that the firing starts from the downward end. In fact, with an opposite firing direction, partial misfiring of the device would result in the pile-up of debris on the unfired lower charges, and this could jam the device in the well casing when the operator subsequently tried to raise it to the surface.

To obtain perforations over a long length, it is possible to fix several supports 22 and to end by means of connecting elements 21. In order for the two cords 62 and 63 to be detonated simultaneously, an explosive relay is employed at the level of each connecting element 21 to synchronize the detonation of these two cords at the beginning of each support 22.

The bottom support 22 is fixed to the lower end piece 24 by a connecting element 71 identical to the element 21 of FIG. 3. The end piece 24 is made up of a tube 72 flattened on top to present a plane connection section 73 adapted to be placed in the connecting element 71. Windows 74 are cut out of the tube and a plug 75 is welded at its lower end. Three rods 76 are welded by their ends at the top and bottom of the tube 72 so that their middle parts are away from the centerline and center the bottom of the apparatus in the well casing. The detonator 66 is placed inside the tube 72.

Figure 6:
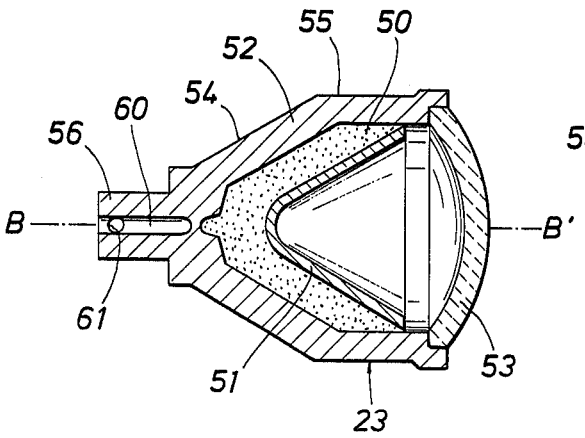
FIGS. 6 and 7, respectively, are transverse and longitudinal views of the encapsulated charges used in the apparatus.
Figure 7:
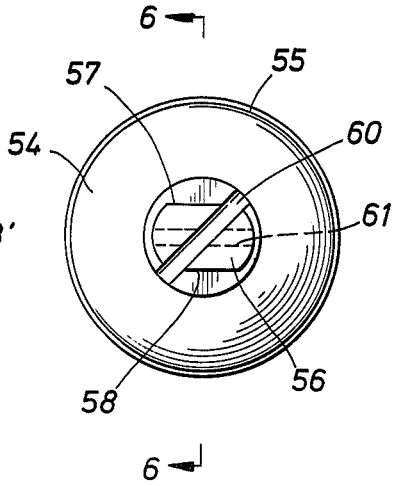

Each charge 23, shown in greater detail in FIGS. 6 and 7, comprises a metallic body 52 and a cover 53 of ceramic material mounted in a sealed manner on the body. The body 52 is made of metal to be fixed solidly on the support. The cover 53 is made of sintered alumina to be fractured into small pieces by the explosion. The body 52 with an axis B-B' contains an explosive load 50 whose front face is hollowed in the form of a cone covered with a metallic liner 51.

The body 52 includes a rear part 56 (or base) of reduced section connected to a front cylindrical part 55 via a truncated part 54. The base 56, whose section is complementary to that of the attachment holes, has two opposite flat parts 57, 58. In the base 56 are cut out a slot 60 for the passage of a detonating cord and a transverse hole 61 adapted to receive a locking pin. Preferably, the slot 60, which extends into the truncated part 54, is inclined about 45 degrees with respect to the plane of the flat parts 57, 58. The body is made by extrusion; i.e., by the plastic deformation of a steel cylinder under the action of a punch moved by a suitable force in the direction of the axis of the body. This extrusion is carried out so as to obtain a body exhibiting an anisotropic mechanical resistance, i.e., a resistance better in the direction of the axis B-B' of the charge than perpendicular to this axis. In this way, under the effect of the explosion, the body 52 breaks along longitudinal lines and flares out from the axis, but remains attached to the base 56, as shown in FIG. 10.

The preferred metal for body 52 is a steel having sufficient strength and malleability to prevent it from breaking up into pieces under the effect of the explosion. Good results have been obtained with low-brittleness steels of the XC 32 F, XC 18 F and 20 MB5 type. Suitable heat treatments can improve the desired properties of the chosen steel.

Figure 8:
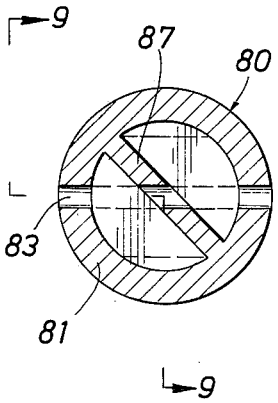
FIGS. 8 and 9, respectively, are transverse and longitudinal cross-sectional views, taken on respective lines 9—9 and 8—8 therein, of a spacer used for well casings of large diameter.
Figure 9:
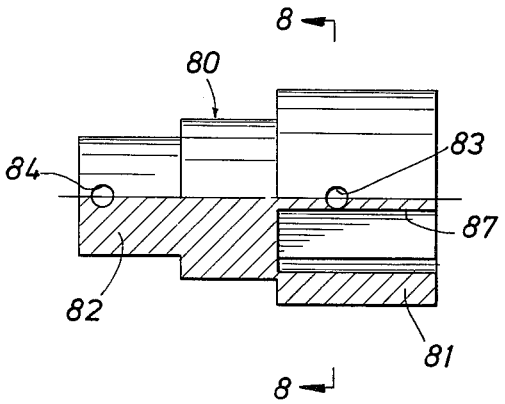

A particular perforating apparatus as shown in FIGS. 2A and 2B will, by virtue of its intrinsic dimensions, be best adapted to a certain range of casing sizes, for example casings with an outer diameter of 17.8 centimeters (7 inches). To perforate casings of different diameters, such as casings with an outer diameter of 24.5 centimeters (9⅝"), the same support 22 is used but the charges 23 are mounted on this support via spacers to reduce the distance between the front part of the charge and the casing. Such a spacer 80, shown in FIGS. 8 and 9, includes an annular part 81 of reinforced thickness, into which fits the base 56 of a charge case, and a rear part 82 of reduced cross section complementary to that of the attachment holes 44 or 45 of the support 22. The annular part 81 has a transverse hole 83 adapted to receive a locking pin 85 (FIG. 10) to fix the base 56 of a charge in the spacer. The rear part 82 has a transverse hole 84 adapted to receive a locking pin 86 to fix the spacer on the support 22.

Inside the annular part 81 is provided a transverse part 87 adapted to be inserted into the slot 60 used for the passage of the detonating cord when the base of a case is placed in the spacer 80. The front face of this transverse part holds the detonating cord over its entire length at the bottom of the slot 60, thereby ensuring suitable transmission of the detonation of the cord to the explosive load of the charge. Furthermore, the presence of this transverse part minimizes the volume of fluid inside the spacer. Without this transverse part, the spacer would contain a large fluid volume filling the cord passage slot 60. This fluid would then transmit the explosion to the walls of the spacer with the risk of shattering the latter and of losing the base of the charge case in the well. In large-diameter wells, in which these spacers are required, the above-described embodiment makes it possible to reduce considerably the amount of debris left in the well.

While the forms of apparatus herein described constitute preferred embodiments of the invention, it is to be understood that the invention is not limited to these precise forms of apparatus, and that changes may be made therein without departing from the scope of the invention.

We claim:

1. A well perforating apparatus comprising:

(a) an elongated metallic support tube having successive portions which are crushed edge to edge in different predetermined radial directions to form a series of flat-faced support sections on and offset angularly around said support along the longitudinal direction thereof, (b) means forming longitudinally spaced attachment holes in said support sections, (c) explosive charges having sealed cases fixed to the support in the attachments holes, (d) means on each of said support sections forming said longitudinally spaced attachment holes in pairs with a distance between the centers of each pair smaller than the maximum diameter of a charge perpendicular to its axis, said attachment holes being configured to support the charges with axes substantially perpendicular to said support section flat faces, (e) rear parts in the charge cases of reduced diameter for engaging in said attachment holes such that two charges are fixed on each of said support sections with the axes of said two charges oriented in opposite radial directions, and (f) detonating means connected to said charges to fire them.

2. The apparatus of claim 1 wherein each two successive flat-faced sections are oriented with perpendicular radial directions so as to obtain explosive charges oriented along four radial directions at 90 degrees.

3. The apparatus of claim 1 wherein each charge case comprises a metallic body member of sufficient strength for the attachment, and a cover member made of a brittle material for breaking into small size debris after the explosion of the charge.

4. The apparatus of claim 3 wherein said metallic body is made of extruded steel having a better breaking resistance in the direction of the charge axis than perpendicular to this axis so that the major part of said body opens under the effect of the explosion of the charge while remaining attached by the rear part to said support after the explosion.

5. The apparatus of claim 3 or 4 wherein said charge case cover member is made of ceramic.

6. The apparatus of claim 1, 2, 3, or 4 further comprising removable spacers configured for insertion between the charges and said support for better perforating boreholes cased with large diameter well casings, with a reduced clearance between the front parts of the charges and the well casing.

7. The apparatus of claim 6 further comprising several types of removable spacers of different predetermined lengths for boreholes having well casings of different diameters.

8. The apparatus of claim 6 wherein the rear parts of each charge include means forming a cord passage slot for the passage of a detonating cord, and wherein each of said spacers further comprises an annular part adapted to surround the rear part of the body of a charge and, inside this annular part, a transverse part adapted to engage in said cord passage slot when the rear part of a charge is placed in the spacer, in order to reduce the volume of fluid inside the spacer, while ensuring proper application of the cord against the charge body.

9. The apparatus of claim 8 wherein said annular part of each spacer has a reinforced thickness.

10. The apparatus of claim 1, 2, or 3 wherein the detonating means comprises two detonating cords connected respectively to a first series of charges consisting of a charge of each section and to a second series of charges consisting of the other charge of each section, and a detonator operated electrically to fire said two detonating cords.

11. The apparatus of claim 10 wherein the detonating means further comprises an explosive relay set off by the detonator to fire the two detonating cords simultaneously.

12. The apparatus of claim 11 further comprising several explosive relays spaced longitudinally along the support, each of said relays being connected to the two detonating cords to maintain the simultaneous detonation of the two detonating cords.

13. The apparatus of claim 10 further comprising means in each charge case forming a detonating cord passage positioned so that, after attaching a charge case on a support section, the detonating cord for firing the respective said charge is disposed along the support side directed toward the front of said charge.

14. The apparatus of claim 1, 2, or 3 further comprising means in each attachment hole forming at least one flat part thereon to prevent the rotation of the charge engaged in this attachment hole.

15. A well perforating apparatus comprising:

(a) an elongated metallic support tube have successive portions which are crushed edge to edge in different predetermined radial directions to form a series of flat-faced support sections on and offset angularly around the support along the longitudinal direction thereof, each two successive flat-faced sections being oriented with perpendicular radial directions so as to provide for orienting explosive charges thereon along four radial directions at 90 degrees, (b) means forming longitudinally spaced attachment holes in said suppot sections, (c) explosive charges having sealed cases fixed to the support in the attachments holes, each charge case including a metallic body member of sufficient strength for the attachment and being made of extruded steel having a better breaking resistance in the direction of the charge axis than perpendicular to this axis so that the major part of said body opens under the effect of the explosion of the charge while remaining attached by the rear part to said support after the explosion, and a cover member made of a brittle ceramic material for breaking into small size debris after the explosion of the charge, (d) means on each of said support sections forming said longitudinally spaced attachment holes therein in pairs with a distance between the centers of each pair smaller than the maximum diameter of a charge perpendicular to its axis, said attachment holes being configured to support the charges with axes substantially perpendicular to said support section flat faces, (e) rear parts in the charge cases of reduced diameter for engaging in said attachment holes such that two charges are fixed on each of said support sections with the axes of said two charges oriented in opposite radial directions, (f) detonating means including two detonating cords connected respectively to a first series of charges consisting of a charge of each section and to a second series of charges consisting of the other charge of each section, an explosive relay connected to fire the two detonating cords simultaneously, and a detonator operated electrically to set off said explosive relay for firing said two detonating cords to fire the respective series of charges connected thereto, and at least one additional explosive relay spaced longitudinally along the support, each of said additional relays being connected to the two detonating cords to maintain the simultaneous detonation of the two detonating cords, (g) means in the rear parts of each charge case forming a detonating cord passage slot for the passage of a detonating cord and positioned so that, after attaching a charge case on a support section, the detonating cord for firing the respective said charge is disposed along the support side directed toward the front of said charge, (h) means in each attachment hole forming at least one flat part thereon to prevent the rotation of the charge engaged in this attachment hole, and (i) a plurality of removable spacers, some of different predetermined lengths for boreholes having well casings of different diameters, each such spacer being configured for insertion between the charges and said support for better perforating boreholes cased with large diameter well casings, with a reduced clearance between the front parts of the charges and the well casing, and each of said spacers having an annular part of reinforced thickness adapted to surround the rear part of the body of a charge and, inside this annular part, a transverse part adapted to engage in said cord passage slot when the rear part of a charge is placed in the spacer, in order to reduce the volume of fluid inside the spacer while ensuring proper application of the cord against the charge body.

16. A method for perforating a well with a high charge density, comprising:

(a) lowering into the well a high charge density perforation apparatus having sealed explosive charge cases with reduced diameter rear parts inserted and fixed, with the axes thereof oriented in opposite radial directions, into respective pairs of longitudinally spaced attachment holes formed in a series of flat-faced support sections on and angularly offset around a support along the longitudinal direction thereof, the support sections having been formed by crushing successive portions of a metallic tube edge to edge in different predetermined radial directions, the distance between the centers of the holes in each pair being smaller than the maximum diameter of a charge perpendicular to its axis, and the holes being configured to support the charges with axes substantially perpendicular to the support section flat faces, and (b) firing the charges.

17. The method of claim 16 further comprising forming the charge cases by extruding a steel body member of sufficient strength for the attachment and having a better breaking resistance in the direction of the charge axis than perpendicular to this axis so that the major part of the body opens under the effect of the explosion of the charge while remaining attached to the support by the rear part of the charge case.

18. The method of claim 16 further comprising reducing the clearance between the front parts of the charges and the well casing by inserting removable spacers between the charges and the support, for better perforating boreholes cased with large diameter well casings.

19. The method of claim 18 further comprising connecting a detonating cord to each charge through a cord passage slot in the rear parts thereof, and engaging a transverse part on the spacer into the slot while placing the rear part of the charge in the spacer to reduce the volume of fluid inside the spacer while ensuring proper application of the cord against the charge body.

20. The method of claim 16 further comprising connecting two detonating cords each respectively to a first series of charges consisting of a charge of each section and to a second series of charges consisting of the other charge of each section, and connecting an electrically operated detonator to the two detonating cords for firing them.

21. A method for perforating a well with a high charge density, comprising:

(a) lowering into the well a high charge density perforation apparatus having sealed explosive charge cases with reduced diameter rear parts inserted and fixed, with the axes thereof oriented in opposite radial directions, into respective pairs of longitudinally spaced attachment holes formed in a series of flat-faced support sections on and angularly offset around a support along the longitudinal direction thereof, the support sections having been formed by crushing successive portions of a metallic tube edge to edge in different predetermined radial directions, the charge cases being formed by extruding a steel body member of sufficient strength for the attachment and having a better breaking resistance in the direction of the charge axis than perpendicular to this axis so that the major part of the body opens under the effect of the explosion of the charge while remaining attached to the support by the rear part of the charge case, the distance between the centers of the holes in each such pair of holes being smaller than the maximum diameter of a charge perpendicular to its axis, the holes being configured to support the charges with axes substantially perpendicular to the support section flat faces, the clearance between the front parts of the charges and the well casing being reduced by inserting removable spacers between the charges and the support, for better perforating boreholes cased with large diameter well casings, the charges being connected for firing by two detonating cords connected respectively to a first series of charges consisting of a charge of each section and a second series of charges consisting of the other charge of each section, each detonating cord being connected to each charge through a cord passage slot in the rear parts thereof, and a transverse part on the spacer being engaged into the slot while placing the rear part of the charge in the spacer to reduce the volume of fluid inside the spacer while ensuring proper application of the cord against the charge body, and an electrically operated detonator being connected to the two detonating cords for firing them, and (b) firing the charges by means of the electrically operated detonator and the detonating cords.

* * * * *